United States Patent [19]

Oono et al.

[11] Patent Number: 4,990,063

[45] Date of Patent: Feb. 5, 1991

[54] CONTROL CYLINDER DEVICE IN VARIABLE DISPLACEMENT COMPRESSOR

[75] Inventors: Hiromitsu Oono; Yasuo Minakawa; Hidetaka Nakasone; Seiji Kato, all of Wako, Japan

[73] Assignee: Honda Giken Kogyo Kabushiki Kaisha, Tokyo, Japan

[21] Appl. No.: 339,782

[22] Filed: Apr. 18, 1989

[30] Foreign Application Priority Data

Apr. 20, 1988 [JP] Japan ..... 63-52912[U]
Apr. 20, 1988 [JP] Japan ..... 63-52913[U]

[51] Int. Cl.[5] ..... F04B 1/28

[52] U.S. Cl. ..... 417/222; 417/270; 91/506

[58] Field of Search ..... 417/222, 270; 92/12.2; 91/506

[56] References Cited

U.S. PATENT DOCUMENTS 2,684,630 11/1951 Widmer et al. ..... 417/222
4,037,993 7/1977 Roberts ..... 417/222
4,231,713 11/1980 Widdowson et al. ..... 417/222
4,506,648 3/1985 Roberts ..... 417/222

FOREIGN PATENT DOCUMENTS 0028453 5/1981 European Pat. Off. .
0207613 1/1987 European Pat. Off. .
2820424 11/1978 Fed. Rep. of Germany .

*Primary Examiner*—Leonard E. Smith
*Assistant Examiner*—John A. Savio, II
*Attorney, Agent, or Firm*—Armstrong, Nikaido, Marmelstein, Kubovcik & Murray

[57] ABSTRACT

In a control cylinder device of a variable displacement compressor, an annular cylinder concentric with a driving rotary shaft is provided in a housing of a compressor body, and an annular control piston is slidably fitted in the cylinder to define a control pressure chamber within the cylinder. The annular control piston is connected to a sleeve, such that the sliding movement of the sleeve can be controlled by the operation of the control piston. Further, inner and outer seal rings are interposed in an axially misaligned relation to each other between inner and outer slide surfaces of the cylinder and control piston. This facilitates an accurate formation of the inner and outer surfaces of the cylinder in the cylinder device on which the control piston slides. Also, this easily insures sealing properties required between the slide surfaces of the cylinder and the piston. In addition, it is possible to effectively prevent the inclination of the control piston within the cylinder.

5 Claims, 2 Drawing Sheets

CONTROL CYLINDER DEVICE IN VARIABLE DISPLACEMENT COMPRESSOR

BACKGROUND OF THE INVENTION

Field of the Invention

The present invention relates to a cylinder device for controlling the change of the angular position of a swingable swash plate to vary the discharged displacement in a variable displacement compressor used for an air-cooler of an automobile or the like.

Description of the Prior Art

There is such a conventionally known variable displacement compressor in which the swinging movement of the swingable swash plate for changing the sliding stroke of an operating piston to vary the discharged displacement is controlled by a cylinder device (see U.S. Pat. No. 4,037,993).

In the above conventional cylinder device, a control piston for controlling the swinging movement of the swingable swash plate is arranged so that its inner peripheral surface is slidably guided by a driving rotary shaft and its outer peripheral surface is slidably guided by a guide member separate from the driving rotary shaft. Therefore, it is difficult to insure high accuracy of concentricity and parallelism of inner and outer guide slide surfaces of the piston. Consequently, this will cause a variation in sealing performance, a deterioration of seals, and an uneven wearing of the sliding surfaces, leading to problems of the performance and reliability of the compressor.

Another problem of the above conventional cylinder device is as follows: It is required to insure sealing properties between sliding surfaces of the cylinder and the control piston slidably fitted in the cylinder to ensure a smooth and nimble operation of the control piston, while preventing a pressurized fluid within a control pressure chamber defined by the above parts from leaking. In order to satisfy such requirements, it is necessary to increase the working accuracies of the cylinder, the control piston and peripheral parts related thereto, resulting in a substantial increase in cost.

SUMMARY OF THE INVENTION

The present invention has been accomplished with the above circumstances in view, and it is an object of the present invention to provide a control cylinder device wherein all of the above problems associated with the conventional device can be overcome.

To attain the above object, according to the present invention, in a variable displacement compressor comprising a compressor body including a housing, a cylinder block and a cylinder head; a driving rotary shaft rotatably carried on the compressor body; a sleeve axially slidably carried on the driving rotary shaft within the housing; a journal supported on the sleeve for swinging movement about an axis perpendicular to an axis of the driving rotary shaft and connected to the rotary shaft; a swingable swash plate carried on the journal so as to be swingable only about the axis of the journal; a plurality of operating pistons connected to the swingable swash plate through a plurality of connecting rods; and a plurality of cylinders disposed around the driving rotary shaft in the cylinder block and each having the corresponding one of the operating pistons slidably received therein, wherein angular positions of the journal and the swingable swash plate are varied by controlling sliding movements of the sleeve in an axial direction of the driving rotary shaft, thereby varying operation strokes of the operating pistons, there is provided a control cylinder device which comprises an annular cylinder provided in an end wall of the housing and concentric with the driving rotary shaft, and an annular control piston slidably fitted in the cylinder to define a control pressure chamber within the cylinder, the annular control piston being connected to the sleeve, so that sliding movement of the sleeve is controlled by the operation of the control piston.

There is also provided a control cylinder device which, in addition to the above construction, includes inner and outer seal rings interposed in an axially misaligned relationship to each other between inner and outer slide surfaces of the cylinder and the control piston.

With the above constructions, the cylinder of the cylinder device for changing the discharged displacement is integrally formed on the housing composing the compressor body, and it is possible to concurrently or continusouly finish-machine the inner and outer peripheral surfaces of the cylinder on which the piston slides, by machining, thereby achieving high accuracy of concentricity and parallelism. This ensures that the control piston slidably fitted in the cylinder is smoothly and nimbly operated, and the sealing properties between the piston and the cylinder is improved.

In addition, the interposition of the seal rings in the axially misaligned relation between the inner and outer slide surfaces of the cylinder and the piston makes it possible to insure the sealing properties between the control piston and the cylinder without increasing machining accuracy of the control piston and the related peripheral parts more than required. Particularly, even if a force intending to tilt the control piston acts on the latter for any reason, the seal rings oppose such force to inhibit tilting of the control piston, thereby insuring the smooth and nimble sliding movement of the control piston.

Further, if the control piston is relatively rotatably supported, via bearings, on a control plate which is connected to the sleeve for rotation in unison with the driving rotary shaft in addition to the above construction, the control piston does not rotate within the cylinder. Thus, the more smooth and nimble operation of the control piston is insured, and the sealing properties between the piston and the cylinder are further improved.

The above and other objects, features and advantages of the invention will become apparent from a reading of the following description of the preferred embodiment, taken in conjunction with the accompanying drawings.

BRIEF DESCRIPTION OF THE DRAWINGS

Drawings illustrate one embodiment of the present invention, wherein.

DESCRIPTION OF THE PREFERRED EMBODIMENT

The present invention will now be described by way of one embodiment with reference to the accomapnying drawings.

Figure 1:
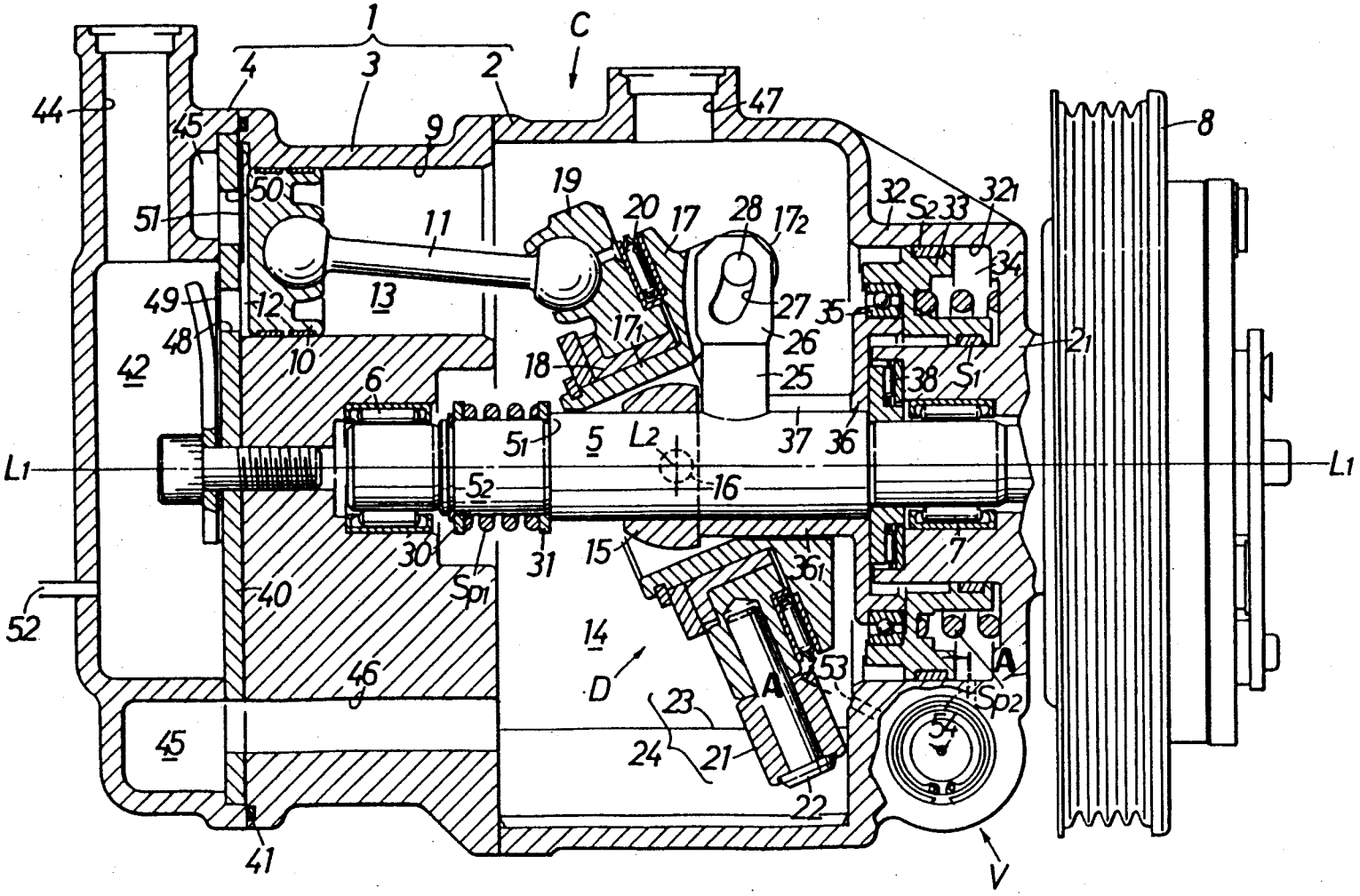
FIG. 1 is a side view in longitudinal section of an essential portion of a variable displacement compressor provided with a device according to the present invention.
Figure 2:
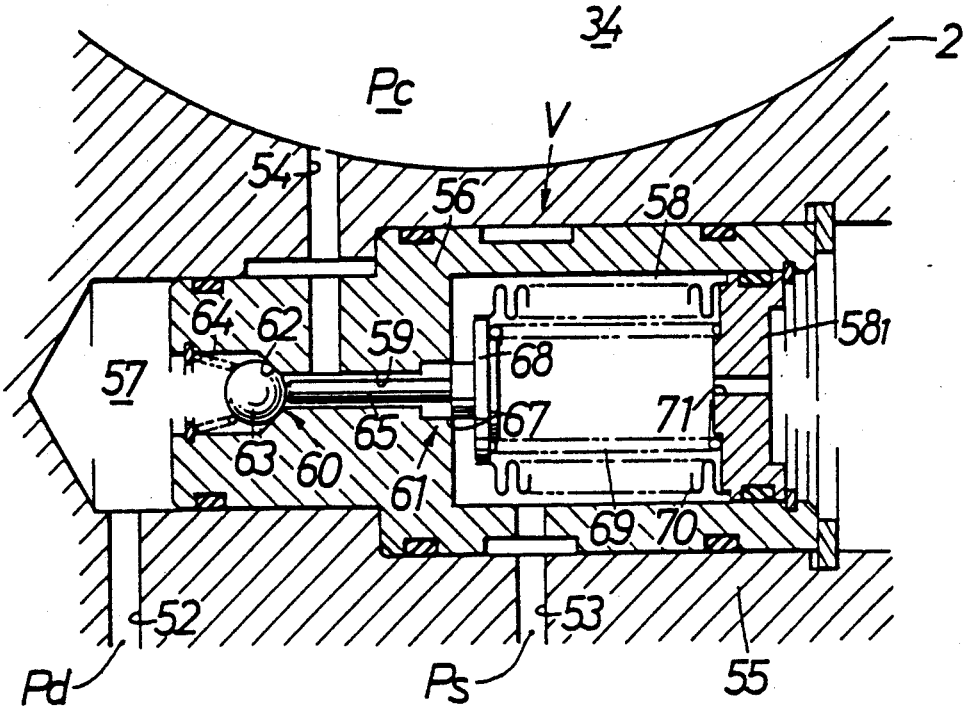
FIG. 2 is a sectional view taken along a lline A—A in FIG. 1.

Referring to FIG. 1, there is shown, in longitudinal section, an essential portion of a variable displacement compressor C in this embodiment. In FIG. 1, a compressor body 1 of the compressor C is generally cylindrically formed of a bottomed hollow cylindrical housing 2, a cylinder block 3 secured to an opened end face of the housing 2, and a cylinder head 4 overlaid on an end face of the cylinder block 3, these components being integrally connected.

A driving rotary shaft 5 longitudinally passing through the housing 2 is rotatably carried in the cylinder block 3 and an end wall $2_1$ of the housing 2 through radial needle bearings 6 and 7. The driving rotary shaft 5 lies on an axis L1 of the compressor body 1 and has a clutch-containing driving pulley 8 integrally connected to a right-hand end of the shaft 5 projecting from the compressor body 1. The driving pulley 8 is operatively connected to a drive source such as an engine which is not shown, so as to be rotatively driven therefrom.

A plurality of cylinders 9 are formed in the cylinder block 3 in parallel to the driving rotary shaft 5 at uniformly spaced apart distances on a concentric circle having its center located on the axis L1, and an operating piston 10 is slidably received in each of these cylinders 9. Each piston 10 divides the interior of the corresponding cylinder 9 into a compression chamber 12 and a back pressure chamber 13. A connecting rod 11 is rotatably connected at one spherical end thereof to a back of each operating piston 10 on the back pressure chamber side. Each of the connecting rods 11 extends axially within the cylinder 9 with the other spherical end thereof reaching the inside of the housing 2, and is rotatably connected to a swingable swash plate 19 of a swash plate type driving mechanism D which will be described hereinafter.

The structure of the swash plate type driving mechanism D will be described below. A sleeve 15 is axially slidably fitted over the driving rotary shaft 5 within a working chamber 14 in the housing 2. A pair of left and right pivots 16 are integrally projected on laterally opposite sides of the sleeve 15 and have a center on an axis L2 (extending normally to the sheet surface of FIG. 1) perpendicular to the axis L1 of the driving rotary shaft 5. A board-like journal 17 is carried on the left and right pivots 16 for backward and forward swinging movement in the axial direction of the driving rotary shaft 5. The swingable swash plate 19 is rotatably carried through a radial bearing 18 on that cylindrical portion $17_1$ of the journal 17 which extends to surround the sleeve 15, and a thrust needle bearing 20 is interposed between opposed faces of the swingable swash plate 19 and the journal 17. A detent member 21 is connected to an outer end of the swingable swash plate 19 through a connecting pin 22 and slidably engaged in a guide groove 23 which is formed within the working chamber 14 in parallel to the driving rotary shaft 5 to extend between one end face of the cylinder block 3 and the end wall $2_1$ of the housing 2. The guide groove 23 and the detent member 21 compose a detent mechanism 24 for the swingable swash plate 19.

A drive pin 25 is integrally provided on the driving rotary shaft 5 to radially project therefrom within the working chamber 14. The drive pin 25 is integrally formed at its leading end with a pair of connecting arms 26 each of which has an arcuate engage hole 27 made therein. An engage pin 28 integrally projecting from a mounting piece $17_2$ of the journal 17 is slidably engaged in the engage holes 27. The arcuate engage holes 27 permit a swinging movement of the swingable swash plate 19 about the pivot 16 to an extent of a length of the engage hole 27. The journal 17 rotates as the driving rotary shaft 5 rotates.

As described above, the connecting rods 11 connected to the corresponding pistons 10 are rotatively connected at the other spherical ends to one face of the swingable swash plate 19. Accordingly, the operation stroke of each operating piston 10, i.e., the displacement, depends upon the angular position of the swingable swash plate 19 about the axis L2 of the pivots 16.

The driving rotary shaft 5 has a smaller diameter shank portion $5_2$ formed at its end closer to the cylinder block 3 through a locking stepped portion $5_1$. A first spring SP1 comprising a compression coiled spring is wound around the smaller diameter shank portion $5_2$ and engaged at one end thereof on a spring seat 30 lockedly fitted over the smaller diameter shank portion $5_2$ and at the other end thereof on an annular stopper 31 locked to the locking stepped portion $5_1$. When the sleeve 15 slides leftward as viewed in FIG. 1, the stopper 31 engages with one end face of the sleeve 15 to compress the first spring SP1.

The housing 2 is integrally provided at a central portion of its end wall $2_1$ with an outwardly projecting cylinder portion 32 of a bottomed cylindrical shape concentric with the driving rotary shaft 5, and an annular control piston 33 is slidably received in an annular cylinder $32_1$ formed in the cylinder portion 32 of the end all. Seal rings S1 and S2 are fitted respectively around inner and outer peripheral surfaces of the control piston 33 in an axially misaligned arrangement to provide a fluid-tight seal between the respective inner and outer slide surfaces of the cylinder $32_1$ and control piston 33. Even if a force intended to tilt the control piston 33 acts on the latter, these seal rings S1 and S2 act to control the tilting of the suppress piston 33 against such force due to their arrangement misaligned axially of the control piston 33.

A control pressure chamber 34 is defined between the control piston 33 and an end wall of the cylinder portion 32. A second spring SP2 comprising a compression coiled spring is contained in the control pressure chamber 34 and has opposite ends engaged between the control piston 33 and the end wall of the cylinder portion 32 to bias the control piston 33 leftward as viewed in FIG. 1, i.e., toward the working chamber 14. The control piston 33 is rotatably carried at its end closer to the working chamber 14 on a control plate 36 through an annular ball bearing 35. The control plate 36 is integrally formed with an axially extending cylindrical portion $36_1$ which is rotatably fitted over and carried on an outer peripheral surface of the driving rotary shaft 5, with its end face engaged with an end face of the sleeve 15 by a repulsive force of the second spring SP2. In addition, the cylindrical portion $36_1$ is provided with an axial slit 37 through which the drive pin extends, so that the driving rotary shaft 5 and the control plate 36 rotate in unison. A thrust needle bearing 38 is interposed between a back of the control plate 36 and the end wall $2_1$ of the housing 2. If the control piston 33 slides laterally as viewed in FIG. 1, the sleeve 15 moves axially to follow the control piston 33 and with such movement, the angular positions of the journal 17 and the swingable swash plate 19 about the pivots 16 are varied. Specifically, when the control piston 33 moves leftward as viewed in FIG. 1, the sleeve 15 also moves leftward. With such movement, the journal 17 and the swingable swash plate 19 turn clockwise, leading to a reduced slide stroke of each operating piston 10. On the other hand, when the control piston 33 moves rightward, the sleeve 15 also moves rightward due to an operational pressure acting on the operating piston 10. With such movement, the journal 17 and the swingable swash plate 19 turn counterclockwise as viewed in FIG. 1, leading to an increased slide stroke of each operating piston 10.

The short cylindrical cylinder head 4 is secured to an end face of the cylinder block through a partition plate 40 with a packing 41 interposed therebetween. The cylinder head 4 includes a discharge chamber 42 centrally defined therein, with a boundary of the discharge chamber 42 with the cylinder block 3 being provided by the partition plate 40. A discharge line 44 formed in the cylinder head 4 communicates with the discharge chamber 42. The cylinder head 4 includes an intake chamber 45 also defined therein to surround the discharge chamber 42, with a boundary of the intake chamber 45 with the cylinder block 3 being also provided by the partition plate 40. The intake chamber 45 communicates with the working chamber 14 in the housing 2 through a communication passage 46 made in the cylinder block 3. Further, an intake line 47 made in a wall of the housing 2 communicates with the working chamber 14.

The partition plate 40 is provided with a discharge port 48 which permits the communication between the discharge chamber 42 and the compression chamber 12 in the cylinder 9, and a discharge valve 49 is mounted in the discharge port 48 and adapted to open the discharge port 48 when the operating piston 10 is in compressing operation. The partition plate 40 is further provided with an intake port 50 which permits the communication between the intake chamber 45 and the compression chamber 12 in the cylinder 9, and an intake valve 51 is mounted in the intake port 50 and adapted to open the intake port 50 when the operating piston 10 is in drawing operation.

When the plurality of operating pistons 10 are reciprocally moved in sequence by the intake stroke of the compressor C, a refrigerant is passed through the intake line 47, the working chamber 14 and the communication passage 46 into the intake chamber 45 from which it is drawn into the compression chamber 12 by opening of the intake valve 51. As a result of a compressing stroke of the compressor C, the compressed refrigerant in the compression chamber 12 opens the discharge valve 49 and is pumped through the discharge chamber 42 into the discharge line 44.

The displacement control of the variable displacement compressor C constructed in the above-described manner is performed by a control valve V. The construction of this control valve V will be described below. The control valve V is interposed among a discharge passage 52 leading to the discharge chamber 42, an intake passage 53 leading to the intake chamber 45 via the working chamber 14 and the communication chamber 46 and a control passage 54 leading to the control pressure chamber 34.

A valve body 56 is mounted in a valve housing 55 formed on the end wall $2_1$ of the housing 2. The valve body 56 defines, within the valve housing 55, a discharge pressure valve chest 57 with which the discharge passage 52 communicates, and the valve body 56 also includes a suction pressure valve chest 58 with which the intake passage 53 communicates, and a passage 59 with which the control passage 54 communicates. The passage 59 permits the communication between the discharge pressure valve chest 57 and the suction pressure valve chest 58.

The valve body 56 is provided with a first valve mechanism 60 capable of putting the discharge pressure valve chest 57 and the passage 59 into and out of communication with each other, and a second valve mechanism 61 capable of putting the passage 59 and the suction pressure valve chest 58 into and out of communication with each other.

The first valve mechanism 60 comprises a valve sphere 63 seatable on a valve seat 62 formed on the valve body 56, a valve spring 64 for biasing the valve sphere 63 in a valve-closing direction, and a push rod 65 for operating the valve sphere 63 in a valve-opening direction. The valve sphere 63 and the valve spring 64 are mounted in the discharge pressure valve chest 57, and the push rod 65 is movably passed longitudinally through the passage 59.

The second valve mechanism 61 comprises a valve spool 68 integral with the push rod 65 and seatable on a valve seat 67 formed on the valve body 56, and a valve spring 69 for biasing the valve spool 68 in a valve-closing direction. The valve spool 68 and the valve spring 69 are contained in the suction pressure valve chest 58 defined in the valve body 56.

A bellows 70 is contained in the suction pressure valve chest 58 to surround the valve spring 69 and is fluid-tightly connected at its opposite ends to the valve spool 68 and an end plate $58_1$ of the suction pressure valve chest 58. The inside of the bellows 70 communicates with the atmosphere via a through hole 71 made in the end plate $58_1$. Thus, if the sucked pressure Ps in the suction pressure valve chest 58 is increased, the bellows 70 is shrinked to open the second valve mechanism 61. If the sucked pressure Ps in the suction pressure valve chest 58 is reduced, the bellows 70 is expanded to open the first valve mechanism 60.

The variable control of the discharge displacement will be described below. An air-cooler has a characteristic that if the cooling load is larger, the sucked pressure Ps is increased, whereas if the cooling load is smaller, the sucked pressure Ps is reduced. Therefore, if the cooling load is now decreased resulting in a reduced sucked-pressure Ps, the valve sphere 63 of the first valve mechanism 60 is opened to place the discharge passage 52 and the control passage 54 into communication with each other, so that the control pressure Pc in the control chamber 34 is increased due to the discharged pressure Pd. With such increase, the control piston 33 is moved leftward as viewed in FIG. 1 by the aid of the repulsive force of the second spring $SP_2$ to move the sleeve 15 leftward. This causes the journal 17 to be swung clockwise about the pivot 16, i.e., in a direction to right the swingable swash plate 19. Consequently, the operation strokes of the plurality of operating pistons 10 are reduced, and the displacement discharged from the compressor is decreased. When the displacement of the compressor becomes a minimum, the sleeve 15 reaches the left limit to compress the first spring $SP_1$ through the stopper 31.

If the load of the air-cooler is increased resulting in an increased sucked-pressure Ps, then the bellows 70 is shrinked, so that the valve spool 68 of the second valve mechanism 61 is opened, and the first valve mechanism 60 is closed. This brings the passage 59 and the suction pressure passage 53 into communication with each other to reduce the pressure Pc in the control chamber 34. With such reduction, the control piston 33 is moved rightward as viewed in FIG. 1. This causes the sleeve 15 to be moved rightward by reception of a working pressure exerted on the plurality of operating pistons 10. Thus, the journal 17 is moved counterclockwise about the pivots 16 to tilt down the swingable swash plate 19 in the same direction, resulting in an increased operation stroke of each operating piston 10 to provide an increased displacement discharged from the compressor C.

The displacement discharged from the variable displacement compressor C is controlled in the above manner.

It should be noted that since the cylinder $32_1$ in which the control piston 33 is slidably fitted is integrally formed on the end wall $2_1$ of the housing 2 composing the compressor body 1 as described above, it is possible to concurrently or continuously finish-machine the inner and outer slide surfaces of the cylinder $32_1$ by machining, thereby insuring high accuracy of concentricity and parallelism of the inner and outer slide surfaces. This ensures that the control piston 33 is smoothly and nimbly operated and moreover, the sealing properties between the cylinder $32_1$ and the control piston 33 are improved.

In addition, since the seal rings S1 and S2 are interposed in the axially misaligned relation, i.e., in an axially spaced fashion from each other, between the inner and outer peripheral surfaces of the cylinder $32_1$ and the control pistons 33, these seal rings enable high sealing properties to be insured between the control piston 33 and the cylinder $32_1$ without need for finish-machining of the control piston 33 and the related peripheral parts with a high accuracy. Particularly, even if a force intending to tilt the control piston 33 acts on the latter, the seal rings S1 and S2 oppose such force to prevent the control piston 33 from being tilted, thereby ensuring the smooth and nimble operation, while insuring the high sealing properties.

What is claimed is:

1. A variable displacement compressor comprising:

a compressor body including a housing, a cylinder block and a cylinder head;

a driving rotary shaft rotatably carried on the compressor body;

a sleeve axially slidably carried on the driving rotary shaft within the housing;

a journal supported on the sleeve for swinging movement about an axis perpendicular to an axis of the driving rotary shaft and connected to the rotary shaft;

a swingable swash plate carried on the journal so as to be swingable only about the axis of the journal;

a plurality of operating pistons connected to the swingable swash plate through a plurality of connecting rods;

a plurality of cylinders disposed around the driving rotary shaft in the cylinder block and each having a corresponding one of the operating pistons slidably received therein, wherein angular positions of the journal and the swingable swash plate are varied by controlling sliding movements of the sleeve in an axial direction of the driving rotary shaft, thereby varying operation strokes of said operating pistons;

said compressor body housing being formed integrally with an outward projecting cylindrical end wall, an inner lateral surface of said end wall being formed as an annular cylinder in said end wall of the housing concentric with the driving rotary shaft; and an annular control cylinder device comprising an annular control piston slidably fitted in said annular cylinder, said annular control piston being connected to the sleeve so that sliding movements of the sleeve are controlled by operation of the control piston.

2. A variable displacement compressor comprising:

a compressor body including a housing, a cylinder block and a cylinder head;

a driving rotary shaft rotatably carried on the compressor body;

a sleeve axially slidably carried on the driving rotary shaft within the housing;

a journal supported on the sleeve for swinging movement about an axis perpendicular to an axis of the driving rotary shaft and connected to the rotary shaft;

a swingable swash plate carried on the journal so as to be swingable only about the axis of the journal;

a plurality of operating pistons connected to the swingable swash plate through a plurality of connecting rods;

a plurality of cylinders disposed around the driving rotary shaft in the cylinder block and each having a corresponding one of the operating pistons slidably received therein, wherein angular positions of the journal and the swingable swash plate are varied by controlling sliding movements of the sleeve in an axial direction of the driving rotary shaft, thereby varying operation strokes of said operating pistons;

said compressor body housing being formed integrally with an outward projecting cylindrical end wall, an inner lateral surface of said end wall being formed as an annular cylinder in said end wall of the housing concentric with the driving rotary shaft; and an annular control cylinder device comprising an annular control piston slidably fitted in said annular cylinder, said annular control piston being connected to the sleeve and including inner and outer seal rings interposed in axially misaligned relationship to each other between respective inner and outer slide surfaces of said cylinder and said control piston so that sliding movements of said sleeve are controlled by operation of said control piston.

3. A variable displacement compressor device comprising an annular control cylinder device according to claim 1 or 2, wherein said control piston is relatively rotatably supported, through a bearing, on a control plate which is connected to said sleeve for rotation in unison with said driving rotary shaft.

4. A variable displacement compressor device comprising an annular control cylinder device according to claim 3, further including a spring contained in said control pressure chamber and having opposite ends engaged between said control piston and a bottom portion of said cylindrical end wall for biasing said control piston toward said sleeve.

5. A variable displacement compressor comprising an annular control cylinder device according to claim 4, wherein said control plate is integrally provided at its central portion with an axially extending cylindrical portion which is fitted over and supported on an outer peripheral surface of said driving rotary shaft, with an end face of said cylindrical portion being engaged with an end face of said sleeve by a repulsive force of said spring.

* * * * *